US010030672B2

(12) United States Patent
Gilarranz et al.

(10) Patent No.: US 10,030,672 B2
(45) **Date of Patent: *Jul. 24, 2018**

(54) METHOD AND SYSTEM FOR COOLING A MOTOR-COMPRESSOR WITH A CLOSED-LOOP COOLING CIRCUIT

(71) Applicant: DRESSER-RAND COMPANY, Olean, NY (US)

(72) Inventors: Jose L. Gilarranz, Katy, TX (US); David J. Peer, Roulette, PA (US); Louis Lombardi, Allegany, NY (US); Steven Rockwood, Allegany, NY (US); William C. Maier, Almond, NY (US)

(73) Assignee: DRESSER-RAND COMPANY, Olean, NY (US)

( * ) Notice: Subject to any disclaimer, the term of this patent is extended or adjusted under 35 U.S.C. 154(b) by 243 days.

This patent is subject to a terminal disclaimer.

(21) Appl. No.: 14/863,679

(22) Filed: Sep. 24, 2015

(65) Prior Publication Data

US 2016/0025106 A1 Jan. 28, 2016

Related U.S. Application Data

(63) Continuation of application No. 13/233,436, filed on Sep. 15, 2011, now Pat. No. 9,200,643.

(60) Provisional application No. 61/407,059, filed on Oct. 27, 2010.

(51) Int. Cl.

| | |
|---|---|
| ***F04D 29/58*** | (2006.01) |
| ***F04D 25/06*** | (2006.01) |
| ***F04D 29/10*** | (2006.01) |
| ***F04D 25/16*** | (2006.01) |

(52) U.S. Cl.

CPC ..... *F04D 29/584* (2013.01); *F04D 25/0606* (2013.01); *F04D 25/0686* (2013.01); *F04D 25/16* (2013.01); *F04D 29/104* (2013.01); *F04D 29/5806* (2013.01)

(58) Field of Classification Search

CPC .. F04D 25/0686; F04D 29/041; F04D 29/056; F04D 29/582; F04D 29/5826; F04D 29/584; F04D 29/083; F04D 29/102; F04D 29/122; F04D 17/122

See application file for complete search history.

(56) References Cited

U.S. PATENT DOCUMENTS

| | | | | |
|---|---|---|---|---|
| 5,382,141 A * | 1/1995 | Stinessen | E21B 43/01 | 166/105.5 |
| 6,390,789 B1 * | 5/2002 | Grob | F04D 17/12 | 417/251 |
| 2009/0151928 A1 * | 6/2009 | Lawson | B01D 19/0057 | 166/105.5 |

(Continued)

*Primary Examiner* — Kenneth J Hansen

(57) ABSTRACT

A fluid compression system is disclosed having a hermetically-sealed housing with at least a motor and a compressor arranged therein. The motor may drive both the compressor and a blower device coupled to the housing or otherwise arranged within the housing and configured to circulate a cooling gas throughout the housing and thereby cool the motor and accompanying radial bearings. The blower device circulates the cooling gas through a closed-loop circuit which may include a heat exchanger and gas conditioning skid. Buffer seals may be used to seal the shaft on both sides of the compressor so as to prevent the migration of liquid and solid contaminants into the closed-loop cooling circuit.

17 Claims, 10 Drawing Sheets

(56) References Cited

U.S. PATENT DOCUMENTS

2009/0317265 A1* 12/2009 Skofteland ..... F04D 17/122
417/53

* cited by examiner

METHOD AND SYSTEM FOR COOLING A MOTOR-COMPRESSOR WITH A CLOSED-LOOP COOLING CIRCUIT

CROSS-REFERENCE TO RELATED APPLICATIONS

This application is a continuation of U.S. patent application Ser. No. 13/233,436, which was filed on Sep. 15, 2011, which claims priority to U.S. Provisional Patent Application Ser. No. 61/407,059, which was filed on Oct. 27, 2010, the disclosures of which are incorporated herein by reference to the extent consistent with the present application.

BACKGROUND

A motor may be combined with a compressor in a single housing to provide what is known as a motor-compressor device. The motor drives the compressor (via a shared rotating shaft supported on each end by a rotor-bearing system) in order to generate a flow of compressed process gas. When used to directly drive a compressor, such as a centrifugal compressor, the shaft is required to rotate at relatively high speeds. In addition to the heat generated by the electrical loss mechanisms that are characteristic of electric motor drivers, operating the motor-compressor device at high speeds increases windage frictional losses generated by the rotating components. If this heat is not properly managed or regulated, it will affect the performance of the motor and potentially damage the electrical insulation of the stator. For the case of machines supported on magnetic bearings, unregulated or unmanaged heat can also adversely affect any accompanying rotor-bearing systems, possibly leading to bearing damage and/or failure.

Prior similar integrated systems have used an external source of pressurized cooling gas in an open-loop cooling arrangement to manage the temperature of the motor and bearing systems. In these applications, the cooling gas is driven primarily by a pressure difference established between the source of cooling gas (typically the discharge of the compressor or an intermediate compressor stage) and the place to which the gas is allowed to flow to (typically the compressor inlet).

Alternatively, in systems that do not use the process gas to cool the motor, and in which the motor and the compressor do not share the same pressure-containing casing, an external fan or blower can circulate cooling air though a motor cooling loop. In such arrangements, the cooling gas is circulated through the motor and bearing systems to ventilate the housing and remove heat. Using an external pressurization system, however, can be problematic, especially if the external fan or blower fails during operation and the flow of cooling gas ceases, resulting in motor/bearing overheating and potential catastrophic failure.

Other prior systems have implemented a quasi-closed loop cooling system which uses a gas circulation mechanism that is machined directly into the rotating shaft. These types of systems, however, have a limited pressure rise capacity due to the selection of the blower design, and if the cooling requirements change, the shaft must be removed and redesigned.

In motor/compressor systems that handle "wet" process gas, such as is common in the upstream applications of the oil and gas industry, the leakage of liquids into the motor/bearing cavity through the radial seals arranged at each end of the compressor shaft has also presented a considerable amount of difficulty. While conventional radial seals may reduce process gas leakage from the compressor, under certain off-design operating conditions, liquid can nonetheless leak across the clearance defined between each radial seal and the rotating shaft, thereby trickling into adjacent bearing cavities and into the motor/bearing cooling circuit. The presence of liquid can potentially damage the bearings and introduce contaminants into the motor area and cooling circuit, which can eventually lead to the deterioration of system components. In many cases, dry gas seals are not robust enough to handle wet process gases and will require a complex gas conditioning and regulating system to avoid liquid ingress into the seal faces. Based on this, they are not good seal candidates, and they may fail when coming into contact with pressurized liquids.

Accordingly, there is a need for an improved more robust cooling system and radial seal system for a motor-compressor arrangement that will not be susceptible to the drawbacks of the prior systems described above.

SUMMARY

Embodiments of the disclosure may provide a fluid compression system comprising. The fluid compression system may include a hermetically-sealed housing comprising a motor end and a compressor end, and the housing of the fluid compression system may define a plurality of internal cooling passages. The fluid compression system may also include a motor and a compressor disposed within the housing. The motor may be coupled with a rotatable shaft and in fluid communication with the plurality of internal cooling passages. The compressor may be axially-spaced from the motor and coupled with the rotatable shaft. The fluid compression system may further include radial bearings disposed at each end of the rotatable shaft, and one or more buffer seals arranged about the rotatable shaft on either side of the compressor and inboard from the radial bearings. The radial bearings may be in fluid communication with the plurality of internal cooling passages, and each buffer seal of the one or more buffer seals may be configured to prevent leakage of a process gas into the plurality of internal cooling passages. The fluid compression system may also include an impeller axially spaced from the compressor and coupled with a free end of the rotatable shaft. The impeller may be configured to circulate a cooling gas in a closed cooling loop through the plurality of internal cooling passages.

Embodiments of the disclosure may also provide another fluid compression system. The fluid compression system may include a hermetically-sealed housing having a motor end and a compressor end, where the housing defines a plurality of internal cooling passages. The fluid compression system may also include a rotatable shaft including a motor rotor section, a first driven section, and a second driven section. The rotatable shaft may extend between the motor end and the compressor end of the housing. A motor may be disposed within the housing and in fluid communication with at least one of the plurality of internal cooling passages. The motor may be coupled with the rotatable shaft and may form part of the motor rotor section of the rotatable shaft that drives the first and second driven sections. The fluid compression system may further include a first compressor disposed in the housing and axially-spaced from the motor. The first compressor may form part of the first driven section of the rotatable shaft. Radial bearings may be disposed proximal each end of the motor rotor and first and second driven sections of the rotatable shaft. The radial bearings may be in fluid communication with at least one of the plurality of internal cooing passages. The fluid compression system may also include one or more buffer seals disposed about the rotatable shaft on either side of the first compressor and inboard from the radial bearings. Each of the buffer seals may be configured to prevent leakage of a process gas into the plurality of internal cooling passages. A first blower may be axially-spaced from the first compressor and coupled with a free first end of the rotatable shaft adjacent the compressor end of the housing. The first blower may be configured to be driven by the motor rotor section of the rotatable shaft to circulate a cooling gas through the plurality of internal cooling passages and regulate a temperature of the motor and the radial bearings. The fluid compression system may also include an external gas conditioning skid fluidly coupled with and disposed downstream from the first blower. The external gas conditioning skid may be configured to receive the cooling gas from the first blower and direct at least a portion of the cooling gas to the one or more buffer seals.

Embodiments of the disclosure may further provide a method of cooling a compression system. The method may include supporting a motor rotor section and a driven section of a shaft within a hermetically-sealed housing with radial bearings. The radial bearings may be disposed at each end of the motor rotor and driven sections, and the housing may define a plurality of internal cooling passages. The method may also include rotating the motor rotor section, and driving the driven section of the shaft with the motor rotor section. The method may further include driving a blower with the motor rotor section, and circulating a cooling gas through the plurality of internal cooling passages with the blower. The blower may be axially-spaced from a compressor and coupled with a free end of the driven section. The method may also include sealing each end of the driven section of the shaft with buffer seals disposed inboard of the radial bearings. The method may also include directing the cooling gas from the blower to an external gas conditioning skid fluidly coupled with the blower, and directing at least a portion of the cooling gas from the external conditioning skid to the buffer seals. The method may further include cooling a motor and the radial bearings with the cooling gas, and directing the cooling gas to the blower in a closed-loop circuit.

Embodiments of the disclosure provide a fluid compression system. The fluid compression system may include a hermetically-sealed housing having a motor end and a compressor end and defining a plurality of internal cooling passages, and a motor arranged within the housing and coupled to a rotatable shaft having a motor rotor section and a driven section, the motor rotor section being adapted to rotate the driven section of the shaft, wherein the motor includes the motor rotor section and is in fluid communication with at least one of the plurality of internal cooling passages. The system may also include a compressor arranged within the housing and axially-spaced from the motor, the compressor including the driven section of the shaft, and radial bearings arranged proximal each end of the motor rotor and driven sections of the shaft, the radial bearings being in fluid communication with at least one of the plurality of internal cooling passages. The system may further include a blower device coupled to the motor end of the housing and driven by the motor rotor section of the shaft, the blower device being configured to circulate a cooling gas through the plurality of internal cooling passages to regulate the temperature of the motor and the radial bearings.

Embodiments of the disclosure may further include a method of cooling a compression system. The method may include supporting a motor rotor section and a driven section of a shaft within a hermetically-sealed housing with radial bearings arranged at each end of the motor rotor and driven sections, the housing defining a plurality of internal cooling passages. The method may further include rotating the motor rotor section of the shaft, driving the driven section of the shaft with the motor rotor section, driving an impeller being coupled to a free end of the motor rotor section, and circulating a cooling gas with the impeller through the internal cooling passages of the housing. The method may also include cooling a motor of the motor rotor section and radial bearings with the cooling gas, and returning the cooling gas to the impeller in a closed-loop circuit.

Embodiments of the disclosure may further include a fluid compression system. The fluid compression system may include a hermetically-sealed housing having a motor end and a compressor end and defining a plurality of internal cooling passages, and a motor arranged within the housing and being coupled to a rotatable shaft, the motor being in fluid communication with the plurality of internal cooling passages. The system may also include a compressor axially-spaced from the motor and coupled to the shaft within the housing, and radial bearings arranged at each end of the shaft and in fluid communication with the plurality of internal cooling passages. The system may further include a carbon ring seal arranged about the shaft on either side of the compressor and inboard from the radial bearings, each carbon ring seal being configured to prevent leakage of process gas into the plurality of internal cooling passages, and an impeller coupled to a free end of the shaft, whereby rotation of the shaft drives the impeller and circulates a cooling gas in a closed cooling loop through the plurality of internal cooling passages.

Embodiments of the disclosure may further include a fluid compression system. The fluid compression system may include a hermetically-sealed housing having a motor end and a compressor end and defining a plurality of internal cooling passages, and a motor arranged within the housing and coupled to a rotatable shaft having a motor rotor section and a first driven section, the motor forming part of the motor rotor section which drives the first driven section, wherein the motor is in fluid communication with at least one of the plurality of internal cooling passages. The system may also include a first compressor axially-spaced from the motor within the housing and forming part of the first driven section of the shaft, radial bearings arranged proximal each end of the motor rotor and first driven sections of the shaft, the radial bearings being in fluid communication with at least one of the plurality of internal cooling passages, and a first blower device coupled to a first free end of the shaft adjacent the compressor end of the housing and driven by the motor rotor section of the shaft, the blower device being configured to circulate a cooling gas through the plurality of internal cooling passages to regulate the temperature of the motor and the radial bearings.

Embodiments of the disclosure may further include a method of cooling a compression system. The method may include supporting a motor rotor section and a driven section of a shaft within a hermetically-sealed housing with radial bearings arranged at each end of the motor rotor and driven sections, the housing defining a plurality of internal cooling passages. The method may also include rotating the motor rotor section, driving the driven section of the shaft with the motor rotor section, driving a blower device with the motor rotor section, the blower device being coupled to a free end of the driven section, and circulating a cooling gas with the blower device through the internal cooling passages of the housing. The method may further include cooling a motor and radial bearings with the cooling gas, the motor forming part of the motor rotor section of the shaft, and returning the cooling gas to the blower device in a closed-loop circuit.

Embodiments of the disclosure may further include a fluid compression system. The fluid compression system may include a hermetically-sealed housing having a motor end and a compressor end and defining a plurality of internal cooling passages, and a motor arranged within the housing and coupled to a rotatable shaft having a motor rotor section and a driven section, the motor forming part of the motor rotor section which drives the driven section, wherein the motor is in fluid communication with at least one of the plurality of internal cooling passages. The system may also include a first compressor axially-spaced from the motor within the housing and forming part of the driven section of the shaft, and radial bearings arranged proximal each end of the motor rotor and driven sections of the shaft, the radial bearings being in fluid communication with at least one of the plurality of internal cooling passages. The system may further include an impeller arranged in a cavity defined within the housing and coupled to the shaft where the motor rotor section meets the driven section, the impeller being driven by the motor rotor section and configured to circulate a cooling gas in a closed-loop cooling circuit through the plurality of internal cooling passages to regulate the temperature of the motor and the radial bearings.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
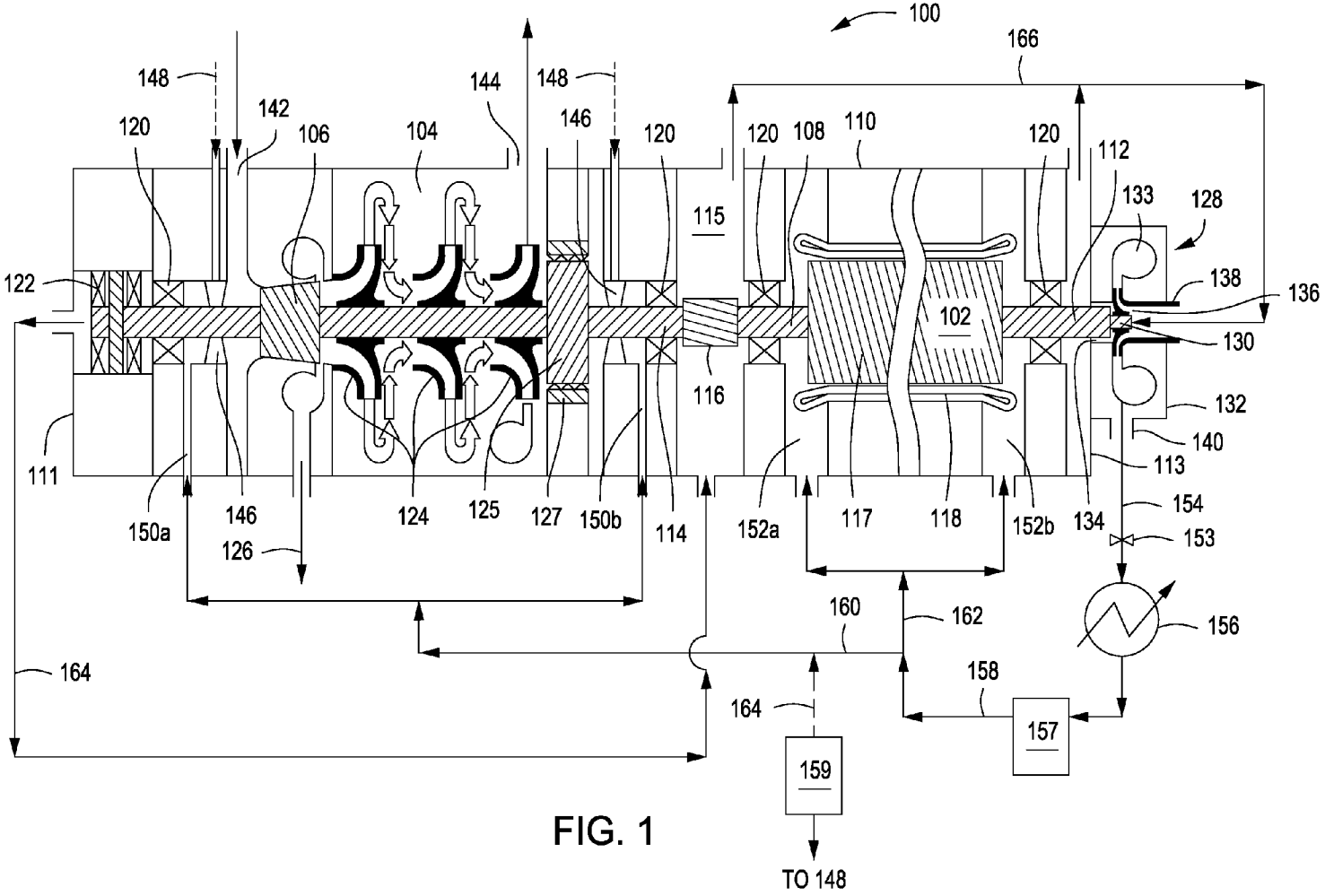
FIG. 1 illustrates an exemplary fluid compression system and closed-loop cooling circuit, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 4:
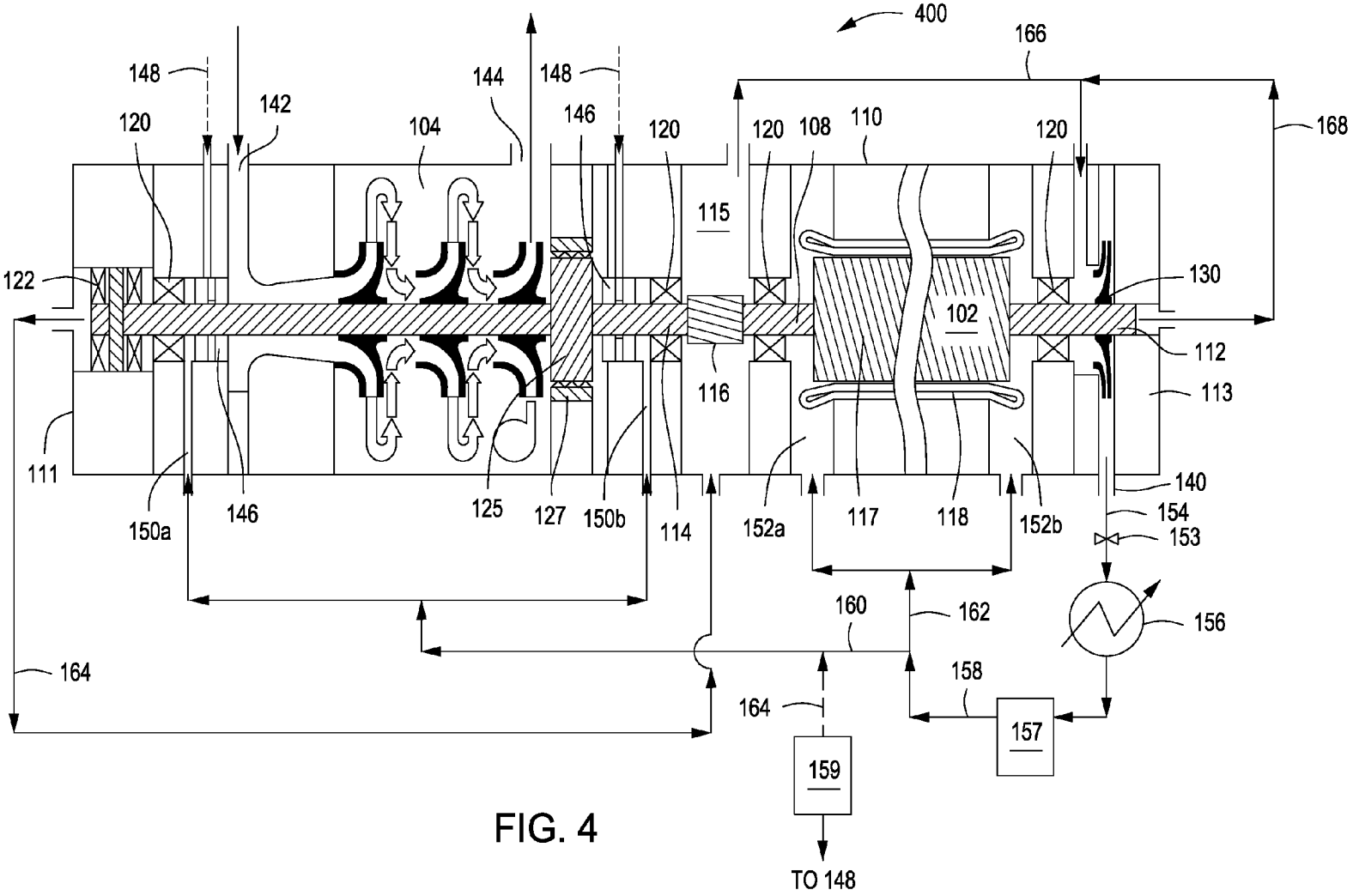
FIG. 4 illustrates another exemplary fluid compression system and closed-loop cooling circuit, according to one or more embodiments disclosed.

FIG. 1 illustrates an exemplary fluid compression system 100 according to embodiments described herein. The system 100 may include a motor 102 coupled to a compressor 104 and an integrated separator 106 via a rotatable shaft 108. In one embodiment, the compressor 104 and the integrated separator 106 may be characterized as an integrated separator/compressor assembly. In other embodiments, however, such as is shown in FIG. 4, the integrated separator 106 may be omitted from the system 100. The motor 102, compressor 104, and integrated separator 106 may each be positioned within a housing 110 having a first end, or compressor end 111, and a second end, or motor end 113. The housing 110 may be configured to hermetically-seal the motor 102, compressor 104, and integrated separator 106 within, thereby providing both support and protection for each component of the system 100.

The shaft 108 extends substantially the whole length of the housing 110, from the compressor end 111 to the motor end 113, and includes a motor rotor section 112 and a driven section 114. The motor rotor section 112 of the shaft 108 is coupled to or otherwise driven by the motor 102. The driven section 114 of the shaft 108 may be coupled to both the compressor 104 and the integrated separator 106. In one or more embodiments, the motor rotor section 112 and driven section 114 may be connected via a coupling 116, such as a flexible or a rigid coupling. The coupling 116 may be arranged within a cavity 115 defined within the housing 110. Accordingly, when the motor rotor section 112 rotates it drives the driven section 114.

The motor 102 may be an electric motor, such as a permanent magnet motor having permanent magnets installed on the rotor 117 and having a stator 118. As will be appreciated, other embodiments may employ other types of electric motors 102 such as, but not limited to, synchronous, induction, brushed DC motors, etc.

The motor rotor section 112 and driven section 114 of the shaft 108 may be supported at each end, respectively, by one or more radial bearings 120 (four sets of radial bearings 120 shown). The radial bearings 120 may be directly or indirectly supported by the housing 110, and in turn provide support to the motor rotor and driven sections 112, 114, which carry the integrated separator 106, compressor 104, and motor 102 during system 100 operation. In one embodiment, the bearings 120 may be magnetic bearings, such as active or passive magnetic bearings. In other embodiments, however, other types of bearings 120 may be used. In addition, at least one axial thrust bearing 122 may be provided at or near the end of the shaft 108 adjacent the compressor end 111 of the housing 110. The axial thrust bearing 122 may be a magnetic bearing and be configured to bear axial thrusts generated by the compressor 104.

The compressor 104 may be a multi-stage centrifugal compressor with one or more, in this case three, compressor stage impellers 124. As can be appreciated, however, any number of impellers 124 may be implemented or used without departing from the scope of the disclosure. The integrated separator 106 may be configured to separate and remove higher-density components from lower-density components contained within a process gas introduced into the system 100. The higher-density components (i.e., liquids or even solids) removed from the process gas can be discharged from the integrated separator 106 via a discharge line 126, thereby providing a relatively dry process gas to be introduced into the compressor 104. Especially in subsea applications where the process gas is commonly multiphase, any separated liquids discharged via line 126 may accumulate in a collection vessel (not shown) and be subsequently pumped back into the process gas at a pipeline location downstream of the compressor 104. Otherwise, separated liquids may simply be drained into the collection vessel for subsequent disposal.

A balance piston 125, including an accompanying balance piston seal 127, may be arranged on the shaft 108 between the motor 102 and the compressor 104. Due to the pressure rise developed through the compressor 104, a pressure difference is created such that the compressor 104 has a net thrust in the direction of its inlet. By being located behind the last impeller 124 of the compressor 104, the balance piston 125 serves to counteract that force. As can be appreciated, any compressor 104 thrust not absorbed by the balance piston 125 may be otherwise absorbed by the thrust bearing(s) 122.

The system 100 may further include a blower device 128 coupled to the motor end 113 of the housing 110. In other embodiments, as will be described below, the blower device 128 may form an integral part of either the compressor end 111 or motor end 113 of the housing 110. During operation, the blower device 128 may circulate a cooling gas through a closed-loop cooling circuit (described below). The cooling circuit may be configured to regulate the temperature of the motor 102 and bearings 120, 122.

The blower device 128 may include at least one impeller 130, such as a blower impeller, disposed within a bolt-on casing or blower casing 132. The impeller 130 may be a centrifugal impeller mounted on or otherwise attached to a free end 134 of the shaft 108 extending through the motor end 113 of the housing 110. Consequently, rotation of the shaft 108 will also serve to drive the impeller 130 and thereby draw fluids into the blower device 128 through an impeller eye 136 axially-aligned with the shaft 108. In other embodiments, the impeller 130 may be an axial-type blower and nonetheless remain within the scope of the disclosure.

The motor end 113 of the housing 110 may be used as the hub side diffuser wall for the blower stage or blower casing 132. The blower casing 132 may include a rigid plate, such as a steel plate, configured to be bolted directly to the motor end 113. As illustrated, the blower casing 132 may include or otherwise define a volute 133. During operation, the blower casing 132 provides a pressure-containing boundary defining an inlet 138 for introducing fluids into the eye 136 of the impeller 130, and a blower stage outlet 140 for discharging pressurized fluids downstream to other components of the system 100. In other embodiments, the diffuser wall may also be defined or otherwise machined into the blower casing 132, thereby generating a one-piece or multiple-piece blower casing 132.

The blower device 128 may be bolted directly to the motor end 113 of the housing 110 (e.g., the exterior of the housing 110) using the existing bolt pattern provided to hermetically-seal the motor 102 within the housing 110. In other embodiments, the blower device 128 is coupled or otherwise attached to the housing 110 in any other manner including, but not limited to, welding, brazing, adhesives, riveting, and/or any combination thereof.

The components of the blower device 128, such as the impeller 130 and the blower casing 132, may be supplied directly from an experienced compressor original equipment manufacturer (OEM), thereby saving time and money that may otherwise be spent by the motor OEM designing and manufacturing specific components to fit specific cooling and/or blower 128 applications. Moreover, mounting the blower device 128 to the motor end 113 of the housing 110 may provide easy access to the components of the blower device 128 for general maintenance. Easy access to the blower device 128 also facilitates reconfiguration of the blower device 128 in order to handle potentially varying flow coefficient blower designs required for varying cooling gas or gases that may be used in the system 100.

In exemplary operation of the system 100, the motor 102 rotates the shaft 108 and thereby simultaneously drives both the compressor 104 and the integrated separator 106. A process gas to be compressed or otherwise treated is introduced into the system 100 via an inlet 142 defined in the housing 110. The process gas may include, but is not limited to, a mixture of hydrocarbon gas, such as natural gas or methane derived from a production field or via a pressurized pipeline. In other embodiments, the process gas may include air, $CO_2$, $N_2$, ethane, propane, i-$C_4$, n-$C_4$, i-$C_5$, n-$C_5$, and/or combinations thereof. In at least one embodiment, especially in subsea oil and gas applications, the process gas may be "wet," having both liquid and gaseous components, or otherwise include a mixture of higher-density and lower-density components. The integrated separator 106 may be configured to receive the process gas via the inlet 142 and remove portions of high-density components therefrom, thereby generating a substantially dry process gas. The liquid and/or higher-density components extracted from the process gas by the integrated separator 106 may be removed via the discharge line 126, as described above.

The compressor 104 may be configured to receive the substantially dry process gas from the integrated separator 106 and compress the dry process gas through the successive stages of impellers 124 to thereby produce a compressed process gas. The compressed process gas then exits the compressor 104 via a process discharge 144 defined in the housing 110.

The reliability and life of the motor 102 and magnetic bearing components 120, 122 used for integrated motor compression systems can be extended by using dry, clean gas in the motor bearing cooling loop. To contain the process gas within the housing 110 and prevent "dirty" process gas from leaking into the adjacent bearing assemblies 120, 122, cooling loop (described below), and motor 102, the system 100 may also include one or more buffer seals 146. The buffer seals 146 may be radial seals arranged at or near each end of the driven section 114 of the shaft 108 and inboard of the bearings 120.

The buffer seals 146 may be brush seals or labyrinth seals. In other embodiments, however, the buffer seals 146 may be dry gas seals or carbon ring seals configured to receive a feed of pressurized seal gas via lines 148. As will be described in more detail below with reference to FIGS. 3 and 4, using carbon rings as buffer seals 146 may significantly reduce the amount of seal gas that is consumed when compared to other seals, thereby increasing motor/compressor performance. Moreover, carbon ring seals may be less expensive and less susceptible to damage than conventional dry gas seal assemblies, especially when processing wet process gases.

The seal gas provided to the buffer seals 146 via lines 148 may be a pressurized process gas derived from the discharge 144 of the compressor 104 and filtered for injection into the buffer seals 146. In other embodiments, however, especially in applications having dry gas seals as buffer seals 146, the seal gas in lines 148 may be a dry and clean hydrocarbon gas, hydrogen, or inert gases such as helium, nitrogen, or $CO_2$. During operation of the system 100, the injection of the seal gas via line 148 may be configured to create a pressure differential designed to prevent process gas leakage across the buffer seal 146 and into locations of the housing 110 where the bearings 120, 122 and the motor 102 are disposed.

In order to cool or otherwise regulate the temperature of the motor 102 and the bearings 120, 122, a cooling gas is circulated throughout the housing 110 in a cooling loop, or closed-loop cooling circuit. Specifically, the closed-loop cooling circuit includes circulating the cooling gas from the blower device 128, through various internal cooling passages 150*a*, 150*b*, 152*a*, and 152*b* defined or otherwise formed within the housing 110, and eventually returning the cooling gas to the blower device 128 to complete the cooling loop. In one or more embodiments, the cooling gas may be the same as the seal gas in lines 148. In other embodiments, the cooling gas, the seal gas, and the process gas may all be the same fluid, which may prove advantageous in maintaining and designing any auxiliary systems.

The blower device 128 may be configured to receive, pressurize, and circulate the cooling gas through the system 100 in the closed-loop cooling circuit. Accordingly, the blower device 128 may be adapted to immerse the motor 102 and bearings 120 in an atmosphere of pressurized cooling gas. Since the impeller 130 is directly coupled to the motor rotor section 112 of the shaft 108, the impeller 130 operates as long as the motor 102 is in operation and driving the shaft 108. As the impeller 130 rotates, it draws in cooling gas through the inlet 138 and into the eye 136 of the impeller 130. The cooling gas is compressed within the blower casing 132 and ultimately ejected from the blower device 128 into line 154 via the blower stage outlet 140.

In order to regulate or otherwise control the head pressure of the cooling gas being discharged from the blower device 128, a valve 153 may either be included at the blower stage outlet 140 or within line 154. Since the motor 102 is generally a variable speed drive, the pressure produced by the impeller 130 will at least partially be a function of the speed of the shaft 108. Consequently, the impeller 130 may be sized or otherwise designed to provide the minimum head pressure required to cool the system 100 when the compressor shaft 108 is rotating at a low speed and ramping up to full power. The valve 153, therefore, may be used to reduce or otherwise regulate the pressure output of the impeller 130 as the system 100 reaches its normal operating speed. As will be appreciated, appropriate control systems and pressure/temperature sensing equipment (not shown) may be coupled to the valve 153 to regulate its position and therefore the pressure of the cooling gas in the cooling loop. In yet other embodiments, the valve 153 may be entirely omitted from the system 100 and the cooling gas may instead be circulated at a pressure proportional to the rotation speed of the shaft 108 and the existing cooling loop system resistance.

The cooling gas in line 154 may be directed through a heat exchanger 156 adapted to reduce the temperature of the cooling gas and generate a cooled cooling gas in line 158. The heat exchanger 156 may be any device adapted to reduce the temperature of a fluid such as, but not limited to, a direct contact heat exchanger, a trim cooler, a mechanical refrigeration unit, and/or any combination thereof. The cooled fluid in line 158 may be directed to a gas conditioning skid 157 configured to filter the cooling gas. In one embodiment, the gas conditioning skid 157 and/or the heat exchanger 156 may include a density-based separator (not shown), or the like, configured to remove any condensation generated by reducing the temperature of the cooling gas.

As will be appreciated, other embodiments contemplated herein include placing the heat exchanger 156 prior to the blower device 128 (e.g., preceding the inlet 138). As can be appreciated, cooling and conditioning the cooling gas prior to entering the blower device 128 may prove advantageous, since a lower-temperature working fluid will demand less power from the motor 102 to compress and circulate the cooling gas.

In one or more embodiments, an external gas conditioning skid 159 may also be included in the system 100 and configured to provide the seal gas for the buffer seals 146 via line 148 during system 100 start-up and during normal operation. This may prove advantageous since during start-up there may exist a pressure differential between the area surrounding the compressor 104 and the area surrounding the motor 102. The seal gas entering the buffer seals 146 may leak into the area surrounding the motor 102 until the motor 102 reaches the desired suction pressure of the compressor 104. The external gas conditioning skid 159 may also provide initial fill gas via line 164 to provide pressurized cooling gas for the system 100 until an adequately pressurized source of process gas/cooling gas is obtained from the discharge 144 of the compressor 104. Accordingly, the initial fill gas may be cooling gas or process gas added to the system 100. During normal operation, the fill gas in line 164 may also be used in the event there is a sudden change in pressure in the system 100 and pressure equilibrium between the compressor 104 and the motor 102 must be achieved in order to stabilize the cooling loop.

The cooled and filtered cooling gas in line 158 may be subsequently separated into lines 160 and 162 before being injected into the internal cooling passages 150*a,b* and 152*a, b*, respectively. The cooling gas in line 160 may be split and introduced into the first internal cooling passages 150*a,b* to cool the bearings 120 that support the driven section 114 of the shaft 108. As the cooling gas nears the bearings 120, the buffer seals 146 generally prevent the cooling gas from passing into the general areas of the integrated separator 106 and compressor 104. Instead, the cooling gas may freely pass through the bearings 120 through a gap (not shown) formed between each bearing 120 and the shaft 108 and toward the ends of the driven section 114 of the shaft 108. As the cooling gas passes through the bearings 120, heat is drawn away to cool or otherwise regulate the temperature of each bearing 120. There may be embodiments where at least a small portion of the seal gas in lines 148 provided to the buffer seals 146 may be combined with the cooling gas at each end of the driven section 114 of the shaft 108.

The cooling gas coursing through the internal cooling passage 150*a* may also cool the axial thrust bearing 122 as it channels toward the compressor end 111 of the housing 110 and ultimately discharges via line 164. The cooling gas in internal cooling passage 150*b* may cool the bearings 120 adjacent the coupling 116 and eventually escape into the cavity 115. The cavity 115 may also receive the cooling gas from the internal cooling passage 150*a* that is discharged from the compressor end 111 of the housing via line 164. Accordingly, the cooling gas channeled through the first internal cooling passages 150*a* and 150*b* may be recombined or otherwise mixed within the cavity 115.

In one or more embodiments, the cooling gas in line 162 may be split or otherwise introduced into the second internal cooling passages 152*a,b* to cool the motor 102 and accompanying bearings 120 that support the motor rotor section 112 of the shaft 108. The cooling gas exits the internal cooling passages 152*a,b* through the bearings 120 (i.e., through the gap formed between each bearing 120 and the shaft 108) on each end of the motor rotor section 112, and thereby remove a portion of the heat generated by the motor 102 and the bearings 120. On one side of the motor 102 (e.g., the left side as shown in FIG. 1), the cooling gas may be discharged through the bearing 120 and into the cavity 115 where it is mixed or otherwise combined with the cooling gas discharged from the internal cooling passages 150*a,b*. The collected cooling gas in the cavity 115 is then discharged from the housing 110 via return line 166. On the other side of the motor 102 (e.g., the right side as shown in FIG. 1), the cooling gas is also discharged from the housing 110 and into the return line 166. As illustrated, the return line 166 may be fluidly coupled to the blower device 128 and configured to deliver the spent cooling gas back to the blower device 128 in order to commence the cooling loop anew. It should be noted that the terms "left" and "right," or other directions and orientations, are described herein for clarity in reference to the Figures and are not to be limiting of the actual device or system or use of the device or system.

Embodiments generally described herein are advantageous for a variety of reasons. For example, the system 100 allows the motor 102, which may otherwise have been cooled in an open-loop circuit, to operate in a hermetically-sealed motor/compressor configuration using a closed-loop cooling circuit adapted to simultaneously cool the motor 102 and the bearings 120, 122. Also, the system 100 can use of an otherwise standard motor configuration without the need to significantly modify the housing 110. For example, the blower device 128 may be bolted to any standard high-speed motor configuration as an upgrade that allows the same motor 102 to operate at different power, speed, and pressure conditions without limiting the cooling capability. As such, the internal cooling passages 150*a,b* and 152*a,b* will generally not need to be modified to fit varying applications, where such modifications require a significant economic investment and long lead times for development. Furthermore, because the impeller 130 is coupled directly to the shaft 108, the system 100 does not require an external driving source but instead operates in tandem with the rotation of the shaft 108.

Figure 2:
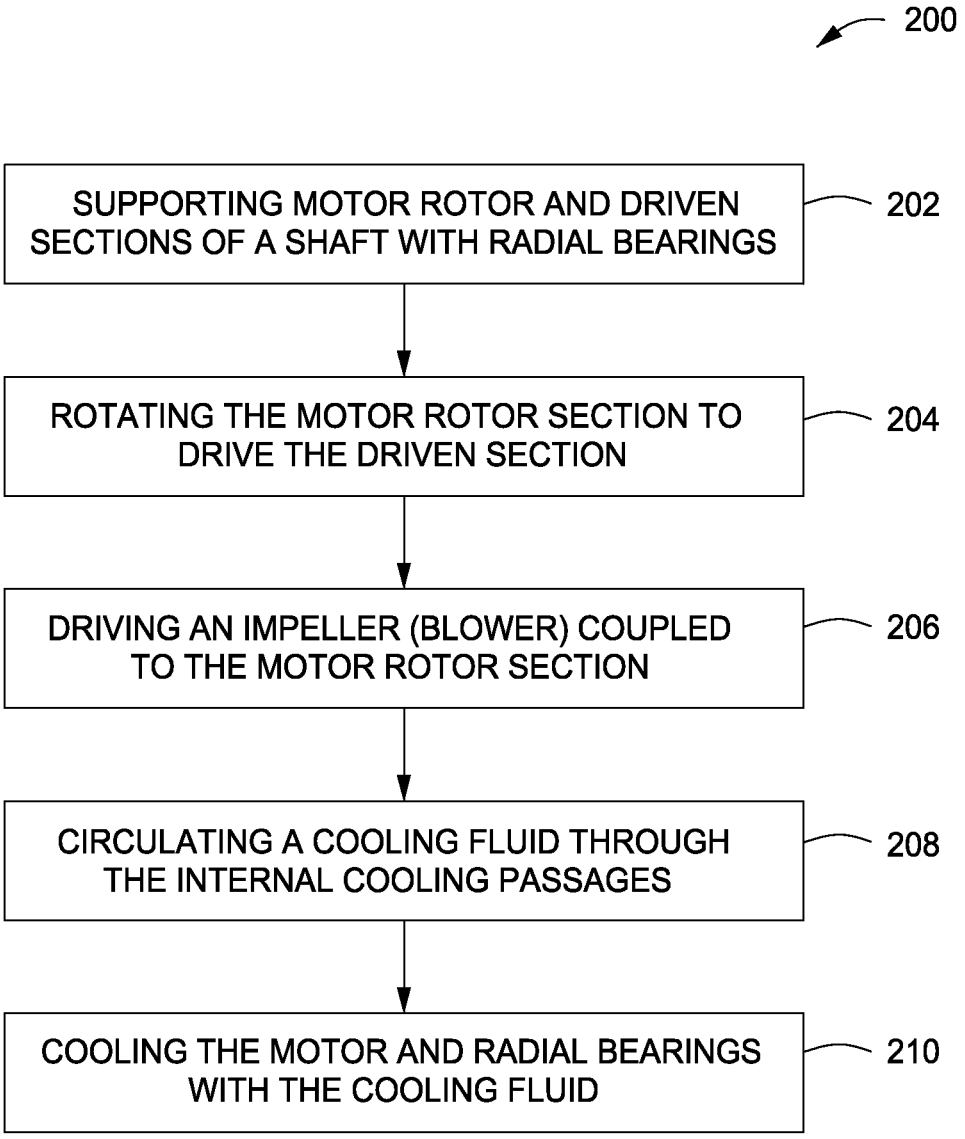
FIG. 2 illustrates a schematic flow chart of a method of cooling a fluid compression system, according to one or more embodiments disclosed.

Referring now to FIG. 2, illustrated is a flowchart of a method 200 for cooling a fluid compression system, such as the system 100 described above and variations thereof. Accordingly, the method 200 may be best understood with reference to FIG. 1 and the embodiments described therewith. The method 200 may include supporting rotor and driven sections of a shaft arranged within a housing using radial bearings, as at 202. The radial bearings may be arranged at each respective end of the rotor and driven sections. The radial bearings may include, for example, magnetic bearings. The shaft, and in particular the driven section of the shaft, may also be supported or otherwise stabilized with an axial thrust bearing. Moreover, the housing may define a plurality of internal cooling passages in fluid communication with the radial bearings and axial thrust bearings. The motor rotor section of the shaft may then be rotated, thereby rotating or driving the driven section of the shaft, as at 204. The motor may also be in fluid communication with the internal cooling passages. In one or more embodiments, a compressor, and potentially a separator, may form part of the driven section of the shaft and be rotatable therewith.

The method 200 may further include driving an impeller, or blower, coupled or otherwise attached to a free end of the motor rotor section, as at 206. The impeller may be arranged within a blower casing coupled to the motor housing. In at least one embodiment, the diffuser may be bolted to the housing using the existing bolt pattern used to hermetically-seal the housing. Rotation of the impeller circulates a cooling gas through the internal cooling passages of the housing, as at 208. The cooling gas may be circulated in a closed-loop circuit whereby it eventually returns to the impeller for recirculation. The cooling gas may cool the motor and radial bearings as it circulates through the internal cooling passages, as at 210. Since the motor and radial bearings are in fluid communication with the internal cooling passages, a portion of the heat generated by the motor and bearings is removed, thereby reducing or otherwise regulating the temperature of the motor and bearings. In embodiments including an axial thrust bearing also arranged on the shaft, the cooling gas may be configured to remove heat therefrom also.

Figure 3:
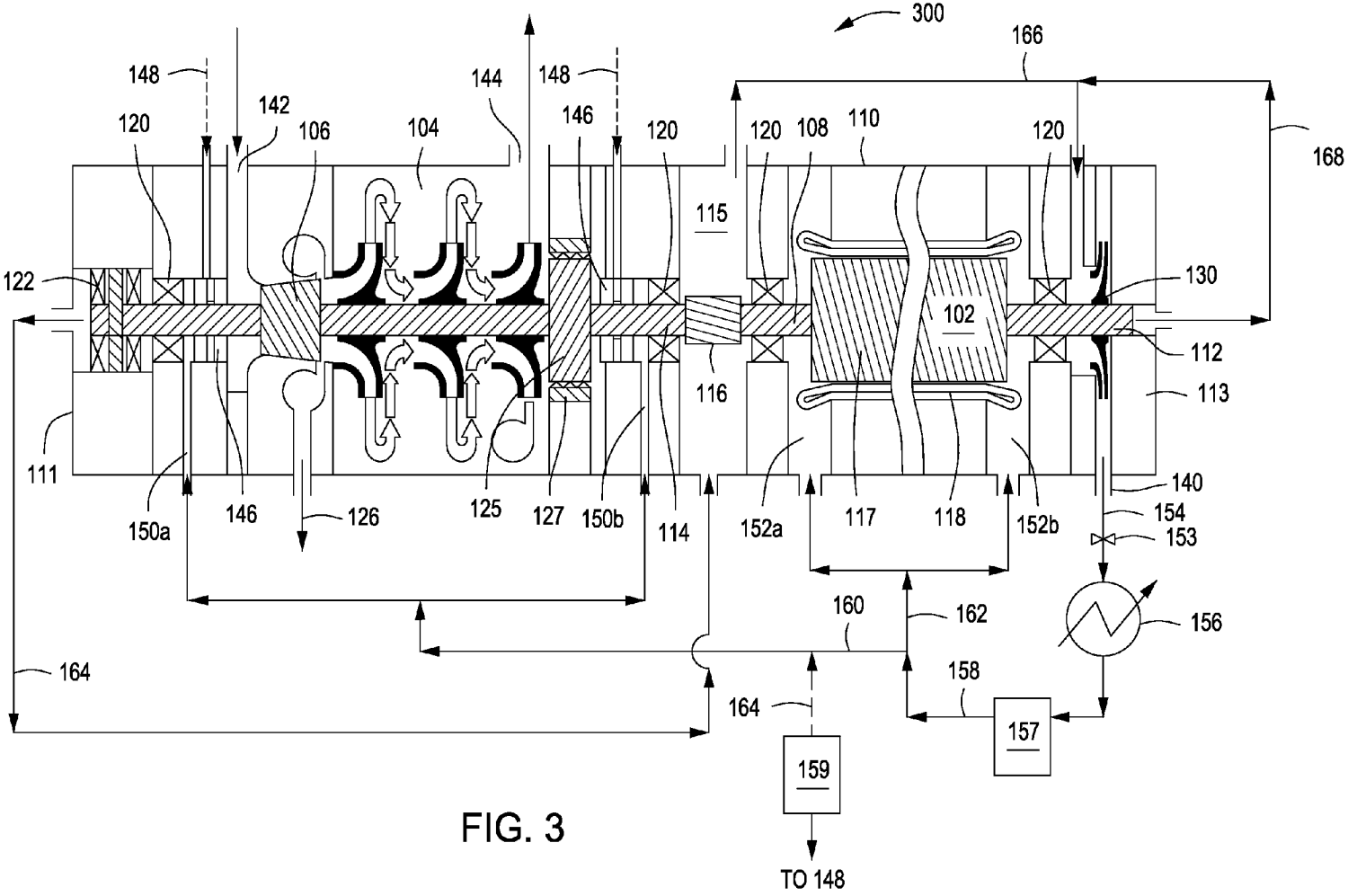
FIG. 3 illustrates another exemplary fluid compression system and closed-loop cooling circuit, according to one or more embodiments disclosed.

Referring now to FIG. 3, depicted is another exemplary fluid compression system 300, similar in some respects to the fluid compression system 100 described above in FIG. 1. Accordingly, the system 300 may be best understood with reference to FIG. 1, wherein like numerals correspond to like components that will not be described again in detail. Unlike the system 100 of FIG. 1, the system 300 of FIG. 3 may arrange the impeller 130 within the confines of the housing 110, but nonetheless remain coupled or otherwise attached at or near the free end of the motor rotor section 112 of the shaft 108. The impeller 130 may be adapted to receive cooling gas from the internal cooling passages 150*a,b* and 152*a,b* via line 166. Line 166 may also be configured to pressurize a balance line 168 fluidly coupled to the motor end 113 of the housing 110 and adapted to counteract or otherwise equalize axial forces generated by the impeller 130.

The impeller 130 may compress and discharge the cooling gas via the blower stage outlet 140 defined by the housing 110 into line 154. The valve 153, if used, regulates or controls the head pressure of the cooling gas being discharged from the impeller 130. The cooling gas channels through the system 300, to cool the motor 102 and accompanying bearings 120, 122, and eventually returns to the impeller 130, thereby completing the closed cooling loop.

Similar to the system 100 of FIG. 1, the buffer seals 146 are disposed at or near each end of the driven section 114 of the shaft 108 but inboard of the bearings 120. The buffer seals 146 may be axially-offset carbon ring seals. While only two rows of carbon rings are shown, it will be appreciated that more than two rows may be used without departing from the scope of the disclosure. Using carbon rings instead of conventional sealing techniques, such as dry gas seals, may be advantageous since carbon rings are generally more robust and less expensive than commercially-available dry gas seals. Also, carbon ring seals do not generally require hydrodynamic forces for appropriate operation, as is the case with dry gas seals. Carbon ring seals can also operate at a smaller clearance than conventional labyrinth seals, thereby decreasing the amount of buffer seal gas required to provide an adequate seal. Moreover, the carbon ring seal design offers replaceable components which can easily be changed out during maintenance turnarounds.

During operation of the system 300, the buffer seals 146 may be adapted to control the amount of buffer seal gas that is consumed and also minimize the potential leakage of dirty process gas into the closed-loop cooling circuit (e.g., into the adjacent internal cooling passages 150*a,b*). The buffer seal gas injected into the buffer seals 146 via lines 148 may be derived from a high pressure source and conditioned (i.e., filtered) using the gas conditioning skid 159 prior to injection. The source of high pressure seal gas for the buffer seals 146 may include, but is not limited to, the discharge 144 of the compressor 104. The seal gas may be injected into the buffer seals 146 at a pressure above the suction pressure of the compressor 104, thereby maintaining the pressure in the motor 102 and cooling loop at a pressure higher than the suction pressure. Consequently, the buffer seals 146 may allow a small amount of cooling gas leakage into the process gas of the compressor 104 and/or integrated separator 106, thereby simultaneously keeping the "dirty" process gas contained therein and preventing migration of liquid and/or solid contaminants across the buffer seals 146 and into the motor 102 and cooling loop.

Referring now to FIG. 4, depicted is another exemplary fluid compression system 400, similar to the fluid compression system 300 of FIG. 3. Accordingly, the system 400 may be best understood with reference to FIGS. 1 and 3, wherein like numerals correspond to like components that will not be described again. The system 400 may be configured as a more traditional motor-compressor arrangement having only a motor 102 and a compressor 104.

Similar to the system 300 of FIG. 3, the system 400 may be configured to circulate a cooling gas through the closed-loop circuit generally described above in order to regulate the temperature of the motor 102 and accompanying bearings 120, 122. Moreover, the system 400 may employ carbon ring buffer seals 146 in order to regulate the amount of seal gas that is consumed and also minimize the potential for leakage of dirty process gas into the cooling loop and the area surrounding the motor 102.

Figure 5:
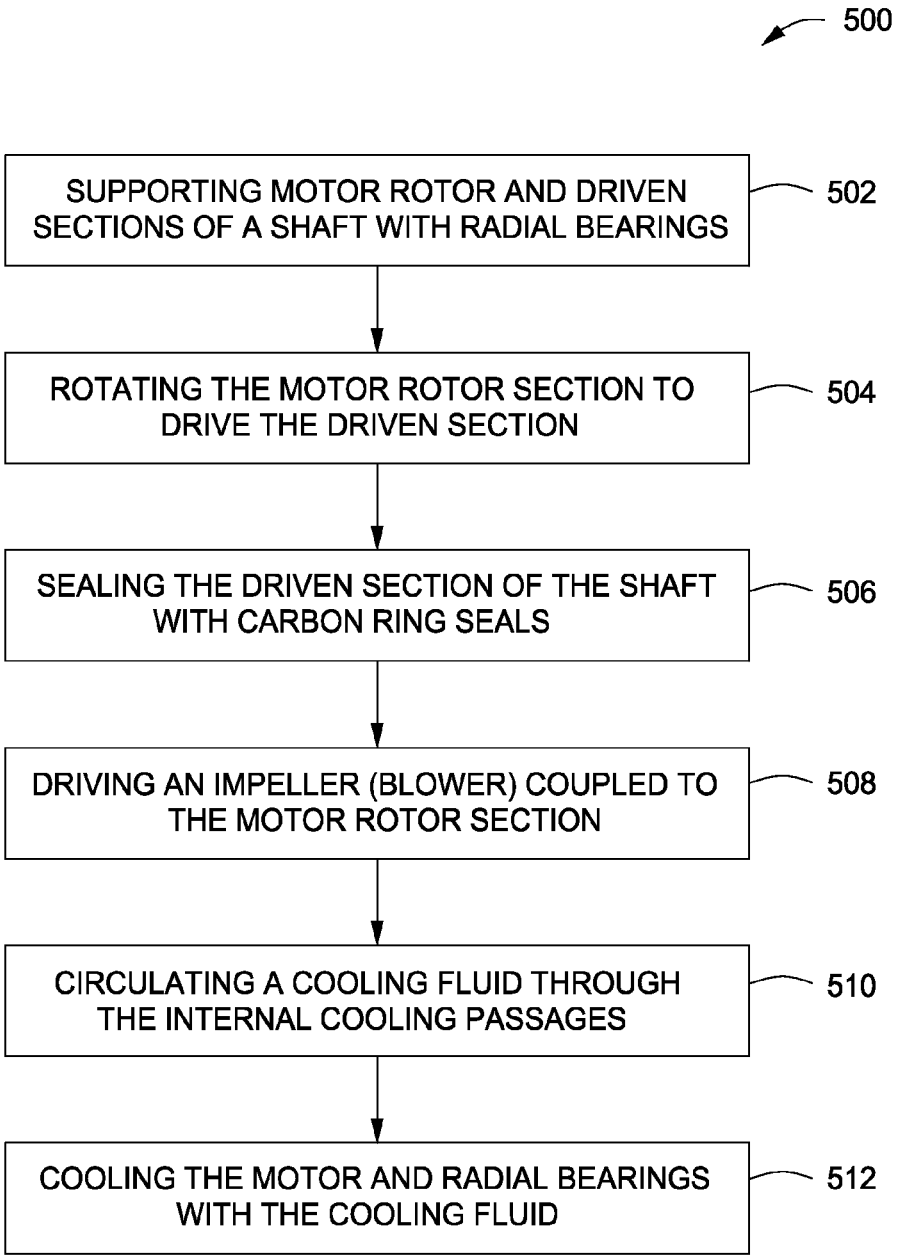
FIG. 5 illustrates a schematic flow chart of another method of cooling a fluid compression system, according to one or more embodiments disclosed.

Referring now to FIG. 5, illustrated is a flowchart of a method 500 for cooling a fluid compression system, such as the systems 300 and 400 described above and variations thereof. Accordingly, the method 500 may be best understood with reference to FIGS. 3 and 4 and the embodiments described therewith. The method 500 may include supporting motor rotor and driven sections of a shaft arranged within a housing using radial bearings, as at 502. The radial bearings may be arranged at each end of the rotor and driven sections and may be, for example, magnetic bearings. The shaft, and in particular the driven section of the shaft, may also be supported or otherwise stabilized with an axial thrust bearing. Moreover, the housing may define a plurality of internal cooling passages in fluid communication with the radial and any axial thrust bearings. The motor rotor section of the shaft may then be rotated to drive the driven section of the shaft, as at 504. The motor that forms part of the motor rotor section of the shaft may also be in fluid communication with the internal cooling passages. In one or more embodiments, a compressor, and potentially a separator, may form part of the driven section of the shaft and be rotatable therewith.

The method 500 may further include sealing the driven section of the shaft with carbon ring seals, as at 506. The carbon ring seals may be arranged at each end of the driven section of the shaft, but inboard of the radial bearings so as to prevent the egress of liquids and solid contaminants into the cooling loop and/or the motor area. The method 500 further includes driving an impeller coupled or otherwise attached to a free end of the motor rotor section, as at 508. The impeller may be arranged within the housing, but may alternatively be arranged within a diffuser coupled to the outside of the housing. In at least one embodiment, the blower casing or diffuser may be bolted to the housing using the existing bolt pattern for hermetically-sealing the housing. In either case, however, as the impeller rotates, a cooling gas is circulated through the internal cooling passages of the housing, as at 510. The cooling gas may be circulated in a closed-loop circuit whereby the cooling gas eventually returns to the impeller for recirculation. The cooling gas cools the motor and bearings as it circulates through the internal cooling passages, as at 512. Since the motor and bearings are in fluid communication with the internal cooling passages, a portion of the heat generated by the motor is removed and the temperature of the motor and bearings is reduced or otherwise regulated. Where an axial thrust bearing is employed, the cooling gas may be configured to remove heat therefrom also.

Figure 6:
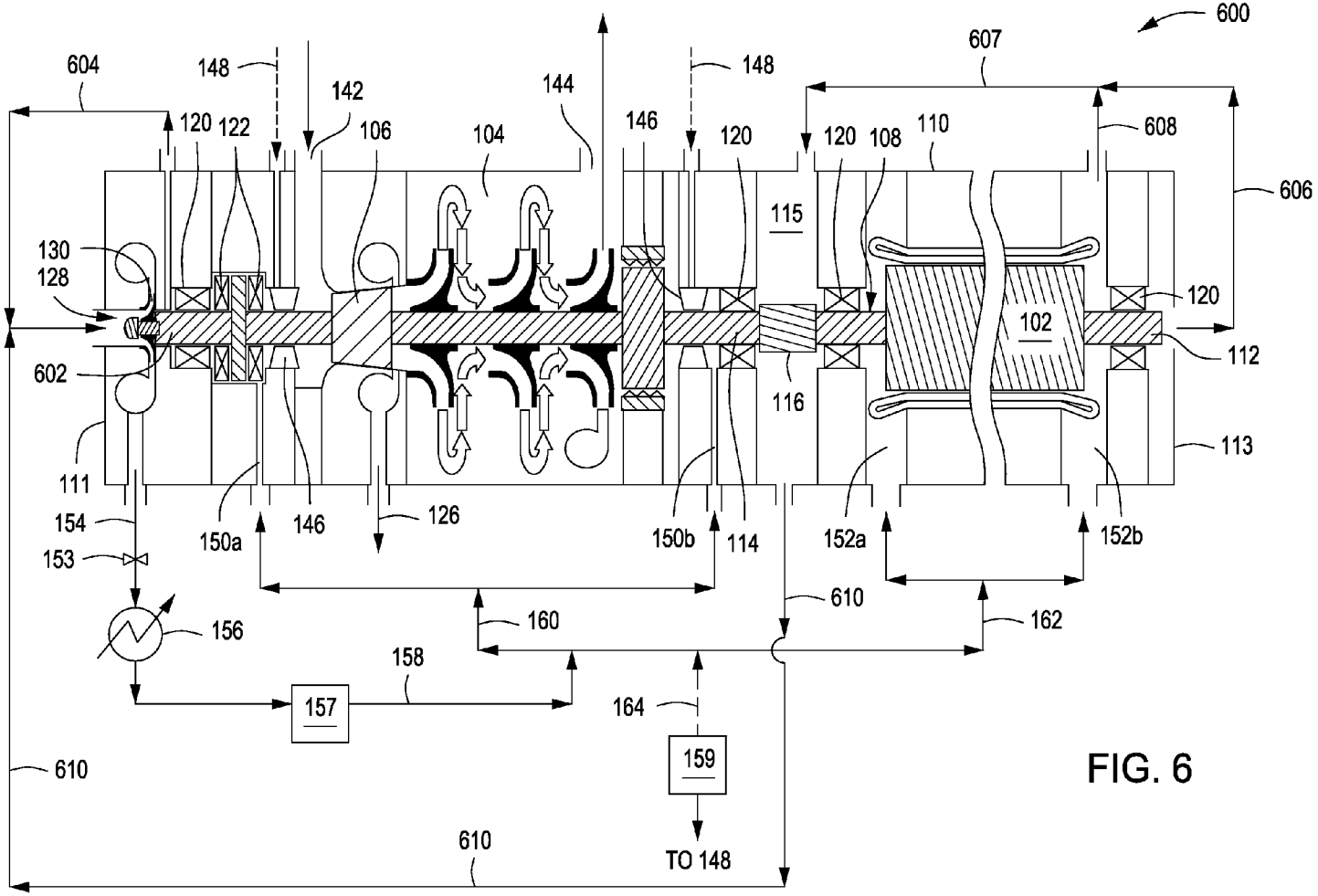
FIG. 6 illustrates another exemplary fluid compression system and closed-loop cooling circuit, according to one or more embodiments disclosed.
Figure 7:
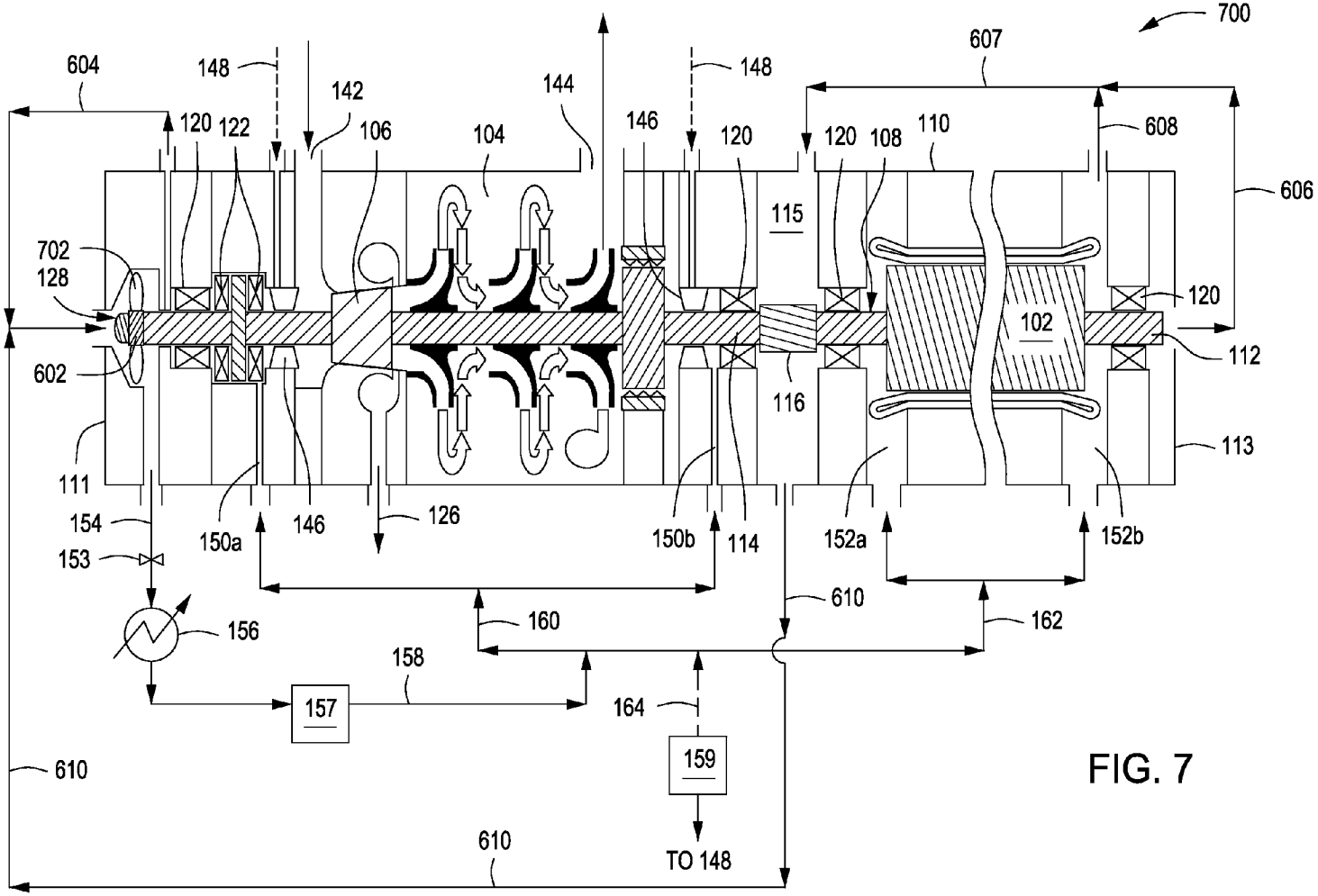
FIG. 7 illustrates another exemplary fluid compression system and closed-loop cooling circuit, according to one or more embodiments disclosed.

Referring now to FIGS. 6 and 7, depicted are other fluid compression systems 600 and 700, similar in some respects to the fluid compression systems 100, 300, and 400 described above. Accordingly, the systems 600 and 700 may be best understood with reference to FIGS. 1, 3, and 4, wherein like numerals correspond to like components that will not be described again. Unlike systems 100, 300, and 400, systems 600 and 700 may have the blower device 128 arranged within the hermetically-sealed housing 110 at or near its compressor end 111. As shown in FIG. 6, the impeller 130 may be coupled or otherwise attached at a free end 602 of the driven section 114 of the shaft 108. In the system 700 depicted in FIG. 7, the impeller 130 may be replaced with an axial fan 702. The axial fan 702 may include axial blading or a mixed flow compression stage device.

Similar to previously-disclosed embodiments, the closed-loop cooling circuit of both systems 600 and 700 may commence and terminate at the blower device 128 which pressurizes and discharges the cooling gas into line 154. The heat exchanger 156 and gas conditioning skid 157 may cool and filter the circulating cooling gas, respectively. The cooled and filtered cooling gas in line 158 is split into lines 160 and 162 to be injected into internal cooling passages 150*a,b* and 152*a,b*, respectively.

Cooling gas coursing through internal cooling passage 150*a* serves to cool the bearings 120, 122 adjacent the compressor side 111 of the housing 110 and is eventually ejected via line 604 and redirected back toward the blower device 128. Cooling gas coursing through internal cooling passage 150*b* cools the bearings 120 adjacent the shaft coupling 116 and is eventually ejected into the cavity 115 for recirculation. Cooling gas in internal cooling passages 152*a,b* may cool the bearings 120 and motor 102 and subsequently pass through the bearings 120 located on both sides of the motor 102 and either enter the cavity 115 on the left side of the motor 102 or escape via balance line 606 on the right side of the motor 102. Cooling gas in the internal cooling passages 152*a,b* may also escape the housing 110 via line 608 which joins balance line 606. Line 608 and the balance line 606 combine to form a return line 607 which is in fluid communication with the cavity 115. The spent cooling gas in the cavity 115 is then be ejected into return line 610 and directed back to the blower device 128 where it is recombined with the cooling gas from line 604. Accordingly, the close-loop cooling circuit may commence anew at the blower device 128.

Figure 8A:
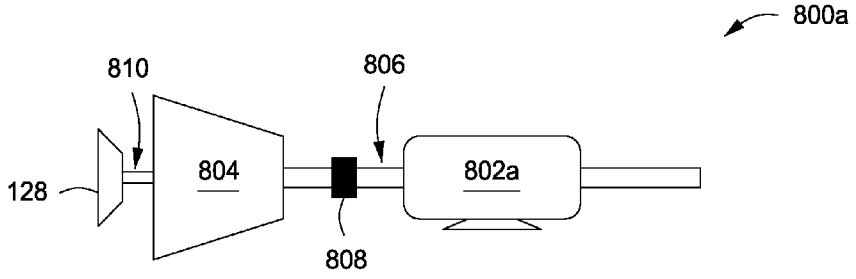
FIGS. 8A-8C illustrate various configurations of a double-ended motor, according to one or more embodiments disclosed.
Figure 8B:
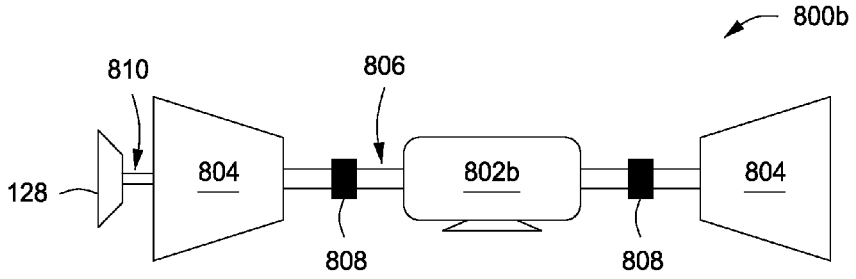
Figure 8C:
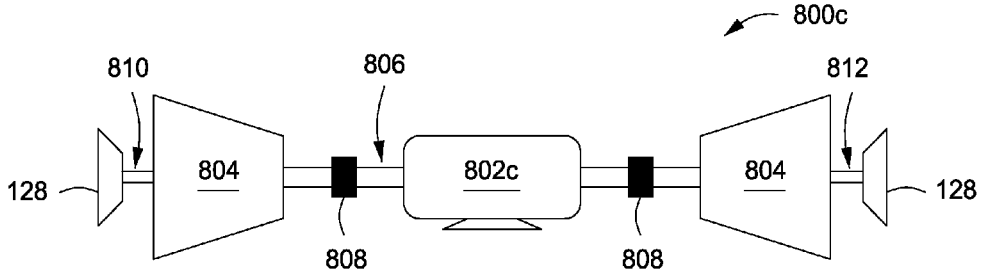

Placing the blower device 128 on the free end 602 of the driven section 114 of the shaft 108 as illustrated in FIGS. 6 and 7, as opposed to the free end of the motor rotor section 112 as illustrated in FIGS. 1, 3, and 4, may serve to increase flexibility on the selection of the particular motor 102 used. For example, having the blower 128 on the free end 602 of the driven section 114 allows the use of a double-ended motor, which may be advantageous in various applications. For example, FIGS. 8A-8C illustrate three exemplary configurations of a motor/compressor system 800 (i.e., depicted as systems 800*a*, 800*b*, and 800*c*) that utilizes a double-ended motor 802. Although not illustrated, it will be appreciated that each system 800*a-c* may be arranged within a hermetically-sealed housing, similar to the housing 110 disclosed in embodiments discussed above.

FIG. 8A depicts a system 800*a* generally similar to systems 600 and 700 of FIGS. 6 and 7, respectively. For instance, system 800*a* includes a motor 802*a* coupled to a compressor 804 on one end of a shaft 806. In at least one embodiment a coupling 808 may be used to connect separate sections of the shaft 806, as generally discussed above. A blower device 128 may be arranged on a first free end 810 of the shaft 806 and configured to rotate therewith. In one embodiment, the blower device 128 is arranged outboard of any bearing assemblies, such as the bearings 120, 122 described above. As can be appreciated, having the blower device 128 arranged outboard of the compressor 804 allows easy access to the blower for service without requiring time-consuming disassembly of the entire system 800*a*. The opposing end of the shaft 806 (e.g., the right side of the shaft as illustrated in FIG. 8A) may be simply supported by another bearing assembly (not shown), as generally described above. In other embodiments, however, the opposing end of the shaft 806 may be coupled to a second motor, such as is disclosed in U.S. Provisional Pat. App. No. 61/407,148 entitled "Multiple Motor Drivers for a Hermetically-Sealed Motor-Compressor System," the contents of which are hereby incorporated by reference to the extent not inconsistent with the present disclosure.

FIG. 8B depicts another system 800*b* where the double-ended motor 802*b* drives two separate compressors 804, each compressor 804 being located on opposing sides of the motor 802*b*. Accordingly, the double-ended motor 802*b* may be adapted to drive both compressors 804 and the blower device 128 arranged on the first free end 810 of the shaft 806. In operation, the blower device 128 provides temperature regulation for the whole system 800*b*. It will be appreciated that the blower device 128 may include either a centrifugal impeller or an axial fan, as discussed in the various embodiments herein.

FIG. 8C illustrates a system 800*c* that is substantially similar to system 800*b*, but adds an additional blower device 128 on the opposing or second free end 812 of the shaft 806. Accordingly, the double-ended motor 802*c* may be adapted to drive the two compressors 804 and two corresponding blower devices 128 on each end 810, 812 of the shaft 806. The dual blower devices 128 may be configured to work in tandem to provide temperature regulation for the system 800*c*.

Figure 9:
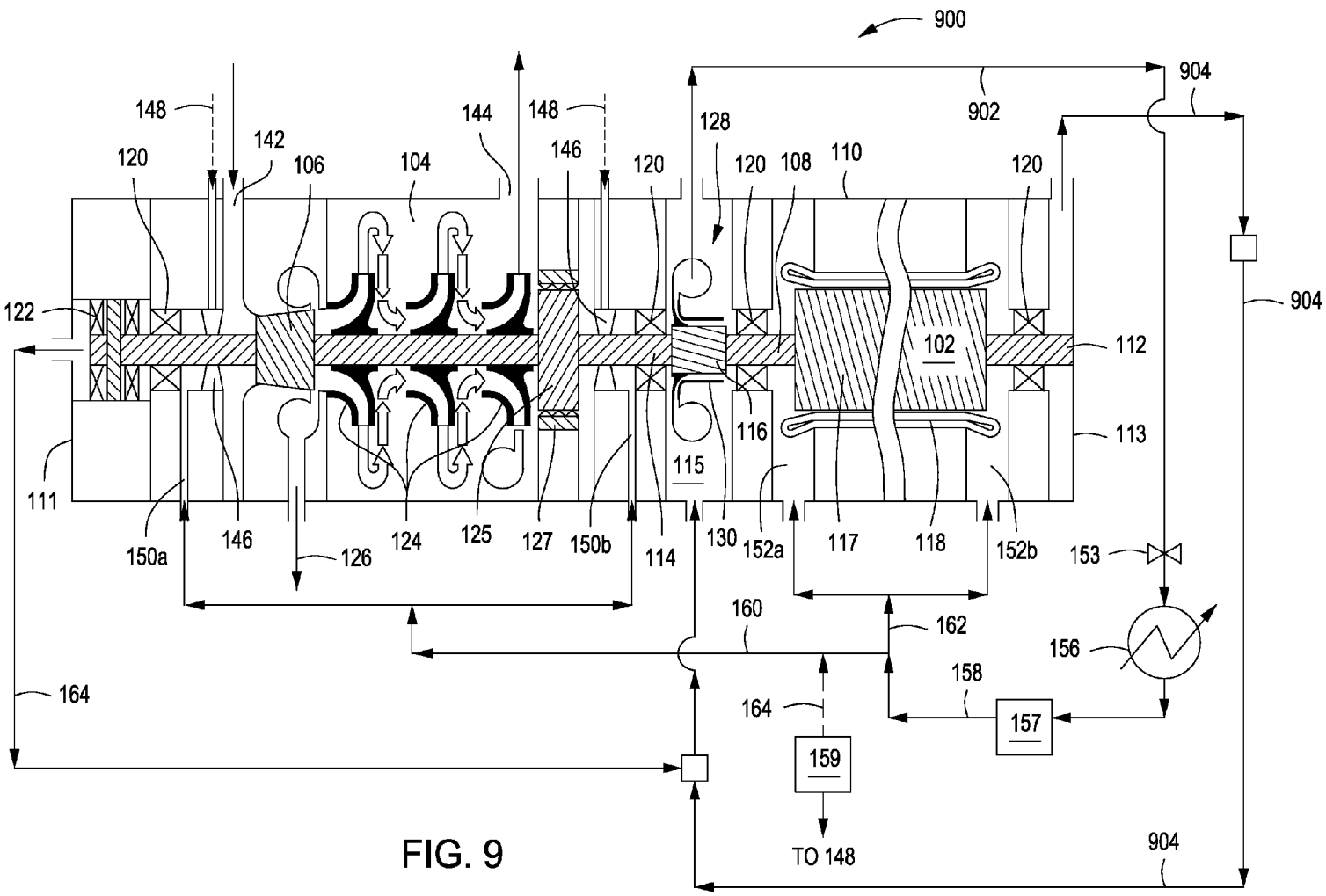
FIG. 9 illustrates another exemplary fluid compression system and closed-loop cooling circuit, according to one or more embodiments disclosed.

Referring now to FIG. 9, illustrated is yet another fluid compression system 900, similar in some respects to systems 100 and 300 discussed above. Accordingly, FIG. 9 may be best understood with reference to FIGS. 1 and 3 where like numerals correspond to like components that will not be described again. As depicted in FIG. 9, the blower device 128 may be arranged within the cavity 115 of the housing. In particular, the blower device 128 may be incorporated into the interconnecting coupling 116 adapted to couple the rotor portion 112 to the driven potion 114 of the shaft 108. As can be appreciated, at least one advantage of the system 900 is that it eliminates the need to have a separate housing for the blower device 128. Consequently, the overall length of the shaft 108 may be shortened, thereby improving shaft 108 rotordynamics.

The impeller 130 may be coupled to or otherwise circumferentially surrounding the coupling 116. In other embodiments, the impeller 130 itself may replace the coupling 116 and be able to withstand shaft 108 rotordynamics associated with operation of the system 900.

In operation, the blower device 128 may be configured to discharge cooling gas from the cavity 115 via line 902. The cooling gas may be directed through the valve 153, heat exchanger 156 and gas conditioning skid 157, as generally described above. The cooling gas in internal cooling passages 152*a,b* may cool the motor 102 and eventually pass through the bearings 120 located on both sides of the motor 102 and either enter the cavity 115 on the left side of the motor 102 or escape via return line 904 on the right side of the motor 102. Return line 904 may be redirected to eventually join return line 164 which is in fluid communication with the cavity 115. The cavity 115 may be designed to channel the spent cooling gas into the blower device 128 and thereby commence the cooling loop anew.

Figure 10:
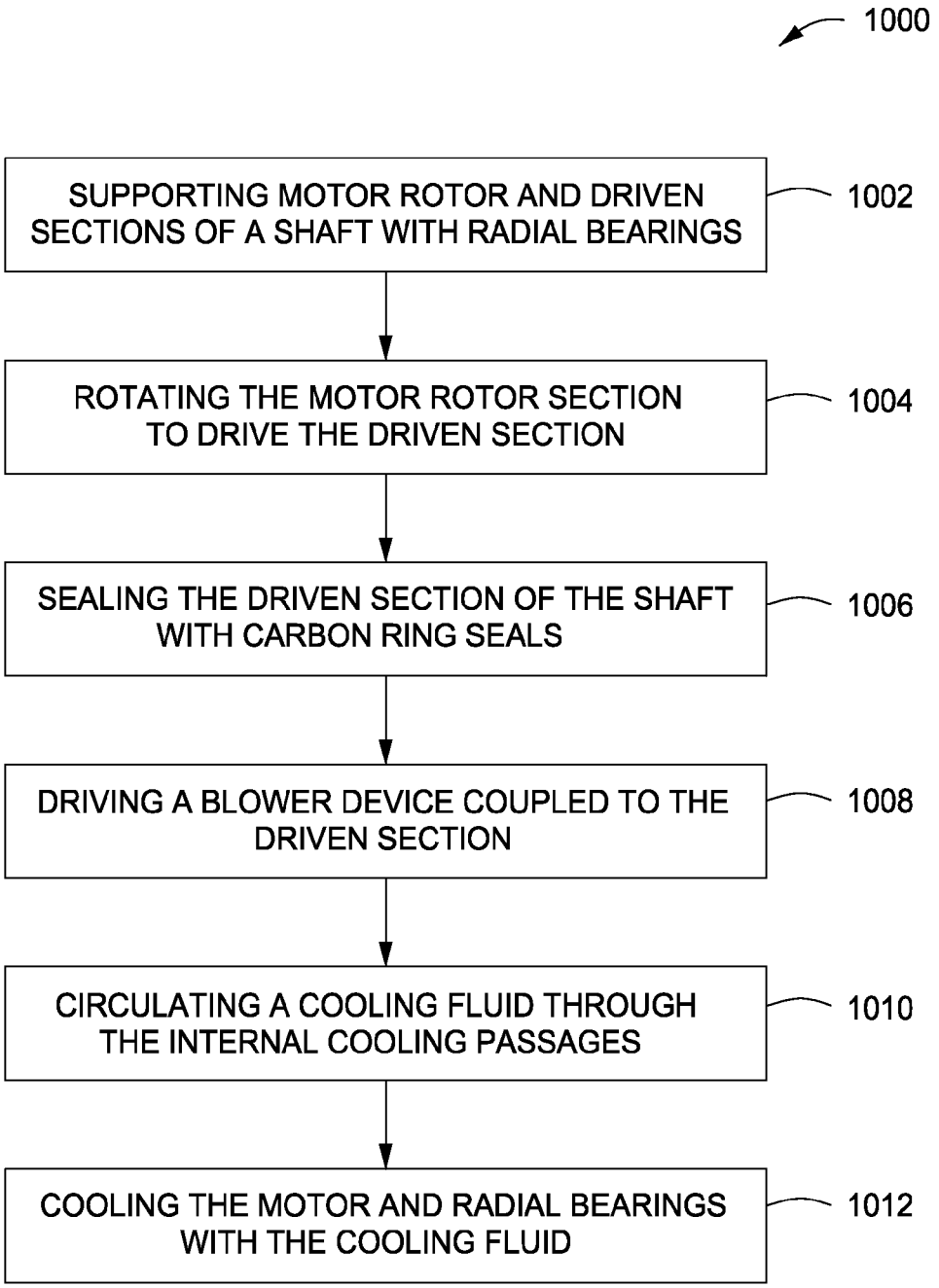
FIG. 10 illustrates a schematic flow chart of another method of cooling a fluid compression system, according to one or more embodiments disclosed.

Referring to FIG. 10, illustrated is a flowchart depicting another method 1000 for cooling a fluid compression system, such as the systems 600 and 700 described above and variations thereof. Accordingly, the method 1000 may be best understood with reference to FIGS. 6 and 7 and the embodiments described therewith. The method 1000 may include supporting rotor and driven sections of a shaft arranged within a housing using radial bearings, as at 1002. The radial bearings may be arranged at each end of the rotor and driven sections and may be, for example, magnetic bearings. The shaft, and in particular the driven section of the shaft, may also be supported or otherwise stabilized with an axial thrust bearing. Moreover, the housing may define a plurality of internal cooling passages in fluid communication with the radial and any axial thrust bearings.

The motor rotor section of the shaft may be rotated to drive the driven section of the shaft, as at 1004. The motor rotor section may form an integral part of the motor which is designed to rotate the shaft. The motor may also be in fluid communication with the internal cooling passages. In one or more embodiments, a compressor, and potentially a separator, may form part of or otherwise be coupled to the driven section of the shaft and be rotatable therewith.

The method 1000 may further include sealing the driven section of the shaft with carbon ring seals, as at 1006. The carbon ring seals may be arranged at each end of the driven section of the shaft, but inboard of the radial bearings so as to prevent the egress of liquids and solid contaminants into the cooling loop and/or the motor area. The method 1000 further includes driving a blower device coupled or otherwise attached to a free end of the driven section, as at 1008. The blower device may be arranged within the housing, and may include a centrifugal impeller. In other embodiments, the blower device may include an axial fan.

As the blower device rotates, a cooling gas is circulated or otherwise forced through the internal cooling passages of the housing, as at 1010. The cooling gas may be circulated in a closed-loop circuit whereby the cooling gas eventually returns to the blower device for recirculation. The cooling gas may cool the motor and bearings as it circulates through the internal cooling passages, as at 1012. Since the motor and bearings are in fluid communication with the internal cooling passages, a portion of the heat generated by the motor and bearings is removed and the temperature of the motor and bearings reduced or otherwise regulated. In embodiments including an axial thrust bearing, the cooling gas may be configured to remove heat therefrom also.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A fluid compression system comprising:

a hermetically-sealed housing comprising a motor end and a compressor end, the housing defining a plurality of internal cooling passages;

a motor disposed within the housing and coupled with a rotatable shaft, the motor being in fluid communication with the plurality of internal cooling passages;

a compressor disposed within the housing, the compressor being axially-spaced from the motor and coupled with the rotatable shaft;

radial bearings disposed at each end of the rotatable shaft and in fluid communication with the plurality of internal cooling passages;

one or more buffer seals arranged about the rotatable shaft on either side of the compressor and inboard from the radial bearings, each buffer seal being configured to prevent leakage of a process gas into the plurality of internal cooling passages; and an impeller axially spaced from the compressor and coupled with a free end of the rotatable shaft, the impeller being configured to circulate a cooling gas in a closed cooling loop through the plurality of internal cooling passages; and an external gas conditioning skid fluidly coupled with and disposed downstream from the impeller, the external gas conditioning skid being configured to receive the cooling gas from the impeller and direct at least a portion of the cooling gas to the one or more buffer seals.

2. The fluid compression system of claim 1, wherein the impeller is disposed adjacent the motor end of the housing.

3. The fluid compression system of claim 2, further comprising a blower casing bolted directly to the motor end of the housing.

4. The fluid compression system of claim 2, further comprising an integrated separator axially-spaced from the compressor and coupled with the rotatable shaft.

5. A fluid compression system, comprising:

a hermetically-sealed housing comprising a motor end and a compressor end, the housing defining a plurality of internal cooling passages;

a rotatable shaft comprising a motor rotor section, a first driven section, and a second driven section, the rotatable shaft extending between the motor end and the compressor end of the housing;

a motor disposed within the housing and in fluid communication with at least one of the plurality of internal cooling passages, the motor being coupled with the rotatable shaft and forming part of the motor rotor section of the rotatable shaft that drives the first and second driven sections;

a first compressor disposed in the housing and axially-spaced from the motor, the first compressor forming part of the first driven section of the rotatable shaft;

radial bearings disposed proximal each end of the motor rotor and first and second driven sections of the rotatable shaft, the radial bearings being in fluid communication with at least one of the plurality of internal cooling passages;

one or more buffer seals disposed about the rotatable shaft on either side of the first compressor and inboard from the radial bearings, each buffer seal being configured to prevent leakage of a process gas into the plurality of internal cooling passages;

a first blower axially-spaced from the first compressor and coupled with a free first end of the rotatable shaft adjacent the compressor end of the housing, the first blower configured to be driven by the motor rotor section of the rotatable shaft to circulate a cooling gas through the plurality of internal cooling passages and regulate a temperature of the motor and the radial bearings; and an external gas conditioning skid fluidly coupled with and disposed downstream from the first blower, the external gas conditioning skid configured to receive the cooling gas from the first blower and direct at least a portion of the cooling gas to the one or more buffer seals.

6. The fluid compression system of claim 5, wherein the first blower comprises a centrifugal impeller or an axial fan.

7. The fluid compression system of claim 5, further comprising an integrated separator axially-spaced from the compressor and coupled with the rotatable shaft.

8. The fluid compression system of claim 5, further comprising a coupling configured to couple the motor rotor section and the first driven section with one another.

9. The fluid compression system of claim 5, further comprising a heat exchanger fluidly coupled with and disposed downstream from the first blower, the heat exchanger being configured to reduce the temperature of the cooling gas from the first blower.

10. The fluid compression system of claim 5, wherein a first end of the motor is coupled with the first driven section and a second end of the motor is coupled with the second driven section.

11. The fluid compression system of claim 10, further comprising a second compressor disposed in the housing and axially-spaced from the motor, the second compressor being coupled with the second driven section of the rotatable shaft.

12. The fluid compression system of claim 11, further comprising a second blower coupled with a second free end of the rotatable shaft and configured to be driven by the motor rotor section.

13. A method of cooling a compression system, comprising:

supporting a motor rotor section and a driven section of a shaft within a hermetically-sealed housing with radial bearings, the radial bearings being disposed at each end of the motor rotor and driven sections, and the housing defining a plurality of internal cooling passages;

rotating the motor rotor section;

driving the driven section of the shaft with the motor rotor section;

driving a blower with the motor rotor section, the blower being axially-spaced from a compressor and coupled with a free end of the driven section;

circulating a cooling gas through the plurality of internal cooling passages with the blower;

sealing each end of the driven section of the shaft with buffer seals, the buffer seals being disposed inboard of the radial bearings;

directing the cooling gas from the blower to an external gas conditioning skid fluidly coupled with the blower;

directing at least a portion of the cooling gas from the external gas conditioning skid to the buffer seals;

cooling a motor and the radial bearings with the cooling gas; and directing the cooling gas to the blower in a closed-loop circuit.

14. The method of claim 13, wherein the blower comprises a centrifugal impeller.

15. The method of claim 13, wherein the blower comprises an axial fan.

16. The method of claim 13, further comprising directing the cooling gas through a heat exchanger to reduce the temperature of the cooling gas.

17. The method of claim 13, further comprising filtering the cooling gas with a gas conditioning skid.

* * * * *